United States Patent [19]

Demi

[11] 4,108,370

[45] Aug. 22, 1978

[54] FUEL CONTROL SYSTEM HAVING BY-PASS MEANS AND PARTS THEREFOR AND THE LIKE

[75] Inventor: Roy C. Demi, Greensburg, Pa.

[73] Assignee: Robertshaw Controls Company, Richmond, Va.

[21] Appl. No.: 771,165

[22] Filed: Feb. 23, 1977

[51] Int. Cl.[2] ..... F23N 1/00

[52] U.S. Cl. ..... 236/15 A; 236/99 R; 251/324

[58] Field of Search ..... 137/454, 2; 251/324, 251/225; 236/15 A, 99 R

[56] References Cited

U.S. PATENT DOCUMENTS

| | | | |
|---|---|---|---|
| 1,881,637 | 10/1932 | Johnson | 236/15 A |
| 3,132,803 | 5/1964 | Wantz et al. | 236/68 D |
| 3,172,422 | 3/1965 | Koch | 251/324 X |
| 3,348,570 | 10/1967 | Nealy | 251/225 X |
| 3,762,639 | 10/1973 | Katchka et al. | 236/15 A |

*Primary Examiner*—William E. Wayner
*Attorney, Agent, or Firm*—Candor, Candor & Tassone

[57] ABSTRACT

A fuel control system having a temperature responsive control device for thermostatically controlling the flow of fuel from a source thereof to a burner and having an adjustable by-pass means by-passing the temperature responsive valve of the device for providing a by-pass flow of fuel from the source to the burner to sustain combustion at the burner, the by-pass means comprising a tubular member provided with an inlet and an outlet for respectively being interconnected to the source and to the burner. The tubular member has a passage therein interconnecting the inlet to the outlet and carries an adjusting member for adjusting the rate of flow of fuel through the passage between the inlet and the outlet of the tubular member and, thus, the amount of fuel being by-passed to the burner. The tubular member has means for interconnecting the source to a pilot burner independent of the passage thereof.

27 Claims, 5 Drawing Figures

FUEL CONTROL SYSTEM HAVING BY-PASS MEANS AND PARTS THEREFOR AND THE LIKE

This invention relates to an improved fuel control system and control device therefor as well as to an adjustable by-pass means therefor or the like.

It is well known to provide a control device for a fuel control system wherein the control device has a temperature responsive valve means for thermostatically controlling the flow of fuel from a source thereof to a burner means and has adjustable by-pass means by-passing the temperature responsive valve means for providing a by-pass flow of fuel from the source to the burner means to sustain combustion at the burner means even though the temperature responsive valve means is in a closed condition. For example, see the U.S. Pat. to Wantz et al, No. 3,132,803.

It is a feature of this invention to provide improved adjustable by-pass means for such a control device and, in particular, for the control device disclosed in the U.S. Pat. to Branson et al, No. 3,989,064.

In particular, one embodiment of this invention provides an adjustable by-pass means for a control device to provide a by-pass flow of fuel from a fuel source to a burner means to sustain combustion at the burner means, the by-pass means comprising a tubular member provided with an inlet and an outlet for respectively being interconnected to the source and to the burner means. The tubular member has a passage therein interconnecting the inlet to the outlet and carries an adjusting member for adjusting the rate of flow of fuel through the passage between the inlet and the outlet of the tubular member and, thus, the amount of fuel being by-passed to the burner means. The tubular member has means for interconnecting the source to a pilot burner means independent of the passage thereof.

In this manner, the fuel control system can be provided with a pilot burner means that can be match lit or the like each time it is desired to utilize the fuel control system and the by-pass means will prevent the flame at the main burner from going completely out and thereby prevent raw gas from being released into the oven or the like when the thermostatic valve of the control device recycles to an open position thereof as will be apparent hereinafter.

Accordingly, it is an object of this invention to provide an improved fuel control system having one or more of the novel features of this invention as set forth above or hereinafter shown or described.

Another feature of this invention is to provide an improved control device having one or more of the novel features of this invention as set forth above or hereinafter shown or described.

Another object of this invention is to provide an improved adjustable by-pass means having one or more of the novel features of this invention as set forth above or hereinafter shown or described.

Other objects, uses and advantages of this invention are apparent from a reading of this description which proceeds with reference to the accompanying drawings forming a part thereof and wherein.

Figure 1:
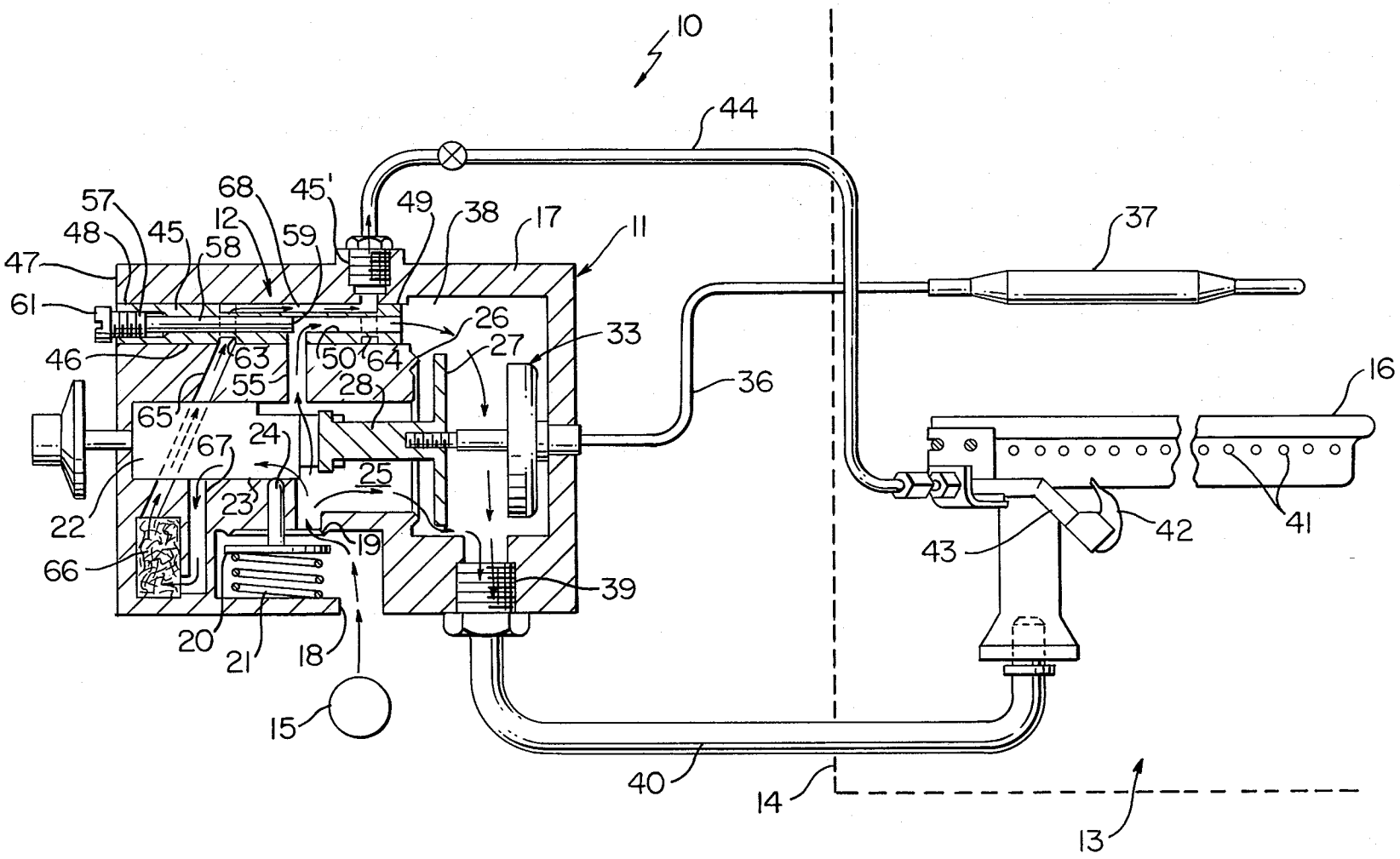
FIG. 1 is a schematic view illustrating the improved fuel control system of this invention.

While the various features of this invention are hereinafter described and illustrated as being particularly adapted to provide an adjustable by-pass means for a fuel control system for a cooking apparatus, it is to be understood that the various features of this invention can be utilized singly or in any combination thereof to provide by-pass means for other systems as desired.

Therefore, this invention is not to be limited to only the embodiments illustrated in the drawings, because the drawings are merely utilized to illustrate one of the wide variety of uses of this invention.

Referring now to FIG. 1, the improved fuel control system of this invention is generally indicated by the reference numeral 10 and comprises a control device 11 of this invention containing the improved adjustable by-pass means of this invention that is generally indicated by the reference numeral 12 in FIG. 1, the control device 11 being utilized in the system 10 to control the temperature within an oven cavity 13 of a cooking apparatus 14 by thermostatically controlling the flow of fuel from a fuel source 15 to a main burner means 16 disposed within the oven 13 in a manner hereinafter described.

Figure 2:
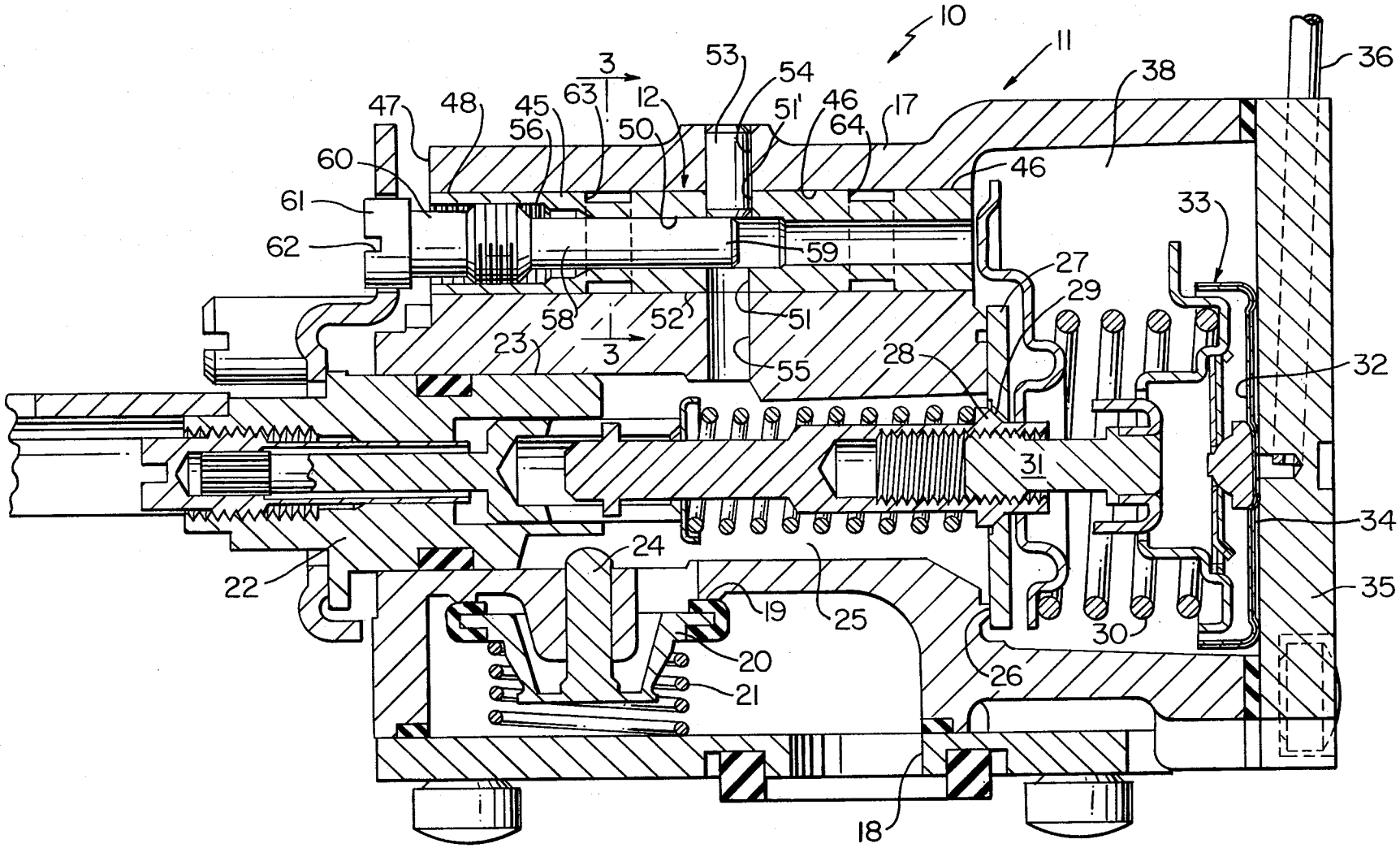
FIG. 2 is an enlarged cross-sectional view illustrating the improved control device of this invention that is utilized in the fuel control system of FIG. 1.

The control device 11 as illustrated in FIGS. 1 and 2 is substantially the same as the control device illustrated and described in the aforementioned U.S. Pat. to Branson et al, No. 3,989,064, except for the adjustable by-pass means 12, and therefore only the details of the control device 11 necessary to understand this invention will be hereinafter set forth as reference can be made to such patent for any further information concerning the details and operation thereof.

In particular, the control device 11 includes a housing means 17 having an inlet 18 adapted to be interconnected to the fuel source 15 by any suitable conduit means, the inlet 18 leading to a valve seat 19 in the housing means 17 that is adapted to be opened and closed by a poppet valve member 20 that is normally urged to the closed position by a compression spring 21 as well as by the pressure of the fuel from the source 15.

The poppet valve member 20 is adapted to be moved to an open position in opposition to such forces when a control shaft 22 is rotated to any "on" position thereof as illustrated in FIG. 1 because the control shaft 22 has a cam surface 23 thereof that cams against a stem 24 of the poppet valve member 20 so that the inlet 18 can be interconnected to an interior chamber 25 of the housing means 17 through the thus opened valve seat 19.

The chamber 25 of the housing means 17 leads to a valve seat 26 adapted to be opened and closed by a temperature responsive valve member 27 telescopically disposed on a shaft member 28 and urged against a hub 29 thereof by a compression spring 30, the shaft member 28 being splined to the control shaft 22 and being threadedly disposed on a threaded stud 31 carried by a movable wall 32 of a power element 33 that has another wall 34 thereof secured to an end plate 35 of the housing means 17.

In this manner, rotation of the control shaft 22 in an "on" direction thereof, cause the shaft member 28 to progressively thread to the right in FIG. 2 or the stud 31 of the power element 33 so that it requires the power element 33 to sense a certain temperature in the oven 13 before the expanding power element 33 through its movable wall 32 will move the valve member 27 against the valve seat 26 to close the valve seat 26, the power element 33 having the chamber between the movable wall 32 and fixed wall 34 thereof interconnected by a capillary tube 36 to a temperature sensing bulb 37 disposed in the oven 13 in a manner well known in the art.

The valve seat 26 leads to a chamber 38 in the housing means 17 which is provided with an outlet 39, FIG. 1 that is interconnected by a conduit 40 to the main burner means 16.

Thus, when the poppet valve member 20 is in an open condition and the valve member 27 is also in an open condition as illustrated in FIG. 1, fuel is adapted to flow from the source 15 to the burner means 16 and issue out of burner ports 41 thereof to be ignited by a flame 42 of a pilot burner means 43 secured adjacent the main burner 16.

The pilot burner means 43 is adapted to have fuel directed thereto by a conduit 44 leading from another outket 45' of the housing means 17 of the control device 11.

In particular, the adjustable by-pass means 12 of this invention provides a dual function, namely, provides a by-pass flow of fuel from the chamber 25 of the control device 11 to the chamber 38 of the control device 11 when the temperature responsive valve means 27 is disposed in a closed condition whereby sufficient fuel is provided to the main burner means 16 to sustain combustion at the burner ports 41 thereof and provides a continuous flow of fuel from the chamber 25 to the pilot burner means 43 to maintain the flame 42 so long as the poppet valve member 20 is in an open condition.

Such adjustable by-pass means 12 includes an elongated cylindrical tubular member 45 disposed in a bore 46 that interrupts one end 47 of the housing means 17 and extends to the chamber 38 thereof as illustrated in FIG. 1 and 2, the tubular member 45 having opposed ends 48 and 49 respectively extending from the end surface 47 of the housing means 17 to the chamber 38 as illustrated and being provided with a stepped passage 50 passing completely therethrough and being concentric with the longitudinal axis thereof.

The tubular member 45 has a transverse bore 51 provided therein leading from the external peripheral surface 52 thereof to the passage 50 intermediate the ends 48 and 49 of the tubular member 45 whereby the bore 51 provides an inlet to the passage 50 of the tubular member 45 while the passage 50 at the end 49 of the tubular member 45 provides an outlet for the tubular member 45 which is in fluid communication with the chamber 38 of the housing means 17.

The passge 51 forming the inlet into the tubular member 45 can comprise a single bore that passes completely through the tubular member 45 to thereby provide another transverse bore 51' coaxially aligned with the inlet bore 51 and which receives a locating pin 53 disposed in a locating bore 54 of the housing means 17 as illustrated in FIG. 2 to position and secure the tubular member 45 in the correct position as illustrated in FIG. 2 whereby the inlet 51 is in full aligned with a passage 55 formed in the housing means 17 and disposed in fluid communication with the chamber 25 thereof. Thus, fuel in the chamber 25 is adapted to enter the inlet 51 of the tubular member 45 by way of the passage 55 and be directed by the passage 50 of the tubular member 45 to the chamber 38 and thereby by-pass the temperature responsive valve means 27 as will be apparent hereinafter.

The passage 50 of the tubular member 45 at the end 48 thereof is internally threaded at 56 so as to threadedly receive a threaded portion 57 of an adjusting member 58 that has one opposed end 59 adapted to extend through the passage 50 and partially or completely block or completely unblock the passage 50 from the inlet 51 of the tubular member 45 depending upon the threaded relation of the threaded portion 57 of adjusting member 58 with the threaded part 56 of the tubular member 45.

The other opposed end 60 of the adjusting member 58 is provided with an enlarged head 61 that projects out of the passage 50 at the end 48 of the tubular member 45 and is suitably slotted at 62 so as to permit adjustment of the adjustable member 58 in its axially relation in the tubular member 45 and, thus, to adjust the amount of fuel flow through the inlet 51 into the passage 50 and, thus, the amount of fuel being by-passed to the main burner 16 when the temperature responsive valve member 27 is in a closed position against the valve seat 26.

The tubular member 45 is provided with two spaced apart annular recesses or grooves 63 and 64 in the outer peripheral surface 52 thereof whereby the annular recess 63 is disposed in fluid communication with a passage 65, FIG. 1, formed in the housing means 17 of the control device 11 and leading from a filter chamber 66 also formed in housing means 17 and being supplied with fuel from the chamber 25 of the housing means 17 by a passage 67. Thus, as long as the poppet valve member 20 is disposed in the open position as illustrated in FIG. 1, fuel is continuously supplied from the source 15 to the annular groove or recess 63 of the tubular member 45.

The other annular groove 64 of the tubular member 45 is so disposed relative to the housing means 17 as illustrated in FIG. 1, that the same is disposed in fluid communication with the outlet 45' leading to the conduit 44 for the pilot burner means 43.

The outer peripheral surface 52 of the tubular member 45 is provided with a longitudinal recess or groove 68 which fluidly interconnects the annular grooves 63 and 64 together whereby the fuel from the annular groove 63 is directed by the longitudinal groove 68 to the annular groove 64 and, thus, to the pilot burner 43 to provide the pilot flame 42 in a continuous manner as long as the poppet valve member 20 is disposed in an open condition and the pilot burner 43 has been initially ignited, such as by a match or other ignition means.

Figure 3:
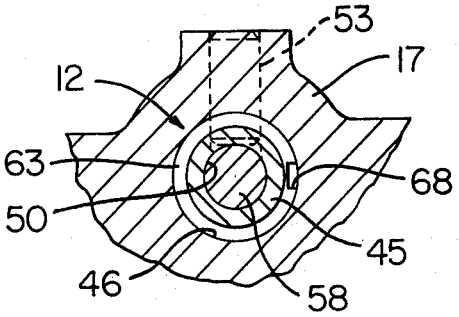
FIG. 3 is a cross sectional view taken on line 3—3 of FIG. 2 and illustrates an adjustable by-pass means of this invention.
Figure 4:
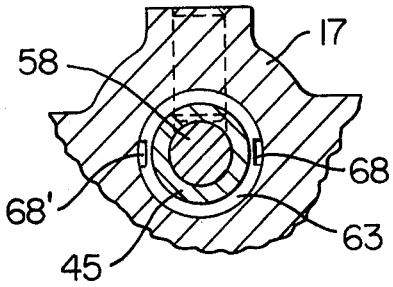
FIG. 4 is a view similar to FIG. 2 and illustrates another embodiment of the adjustable by-pass means of this invention.
Figure 5:
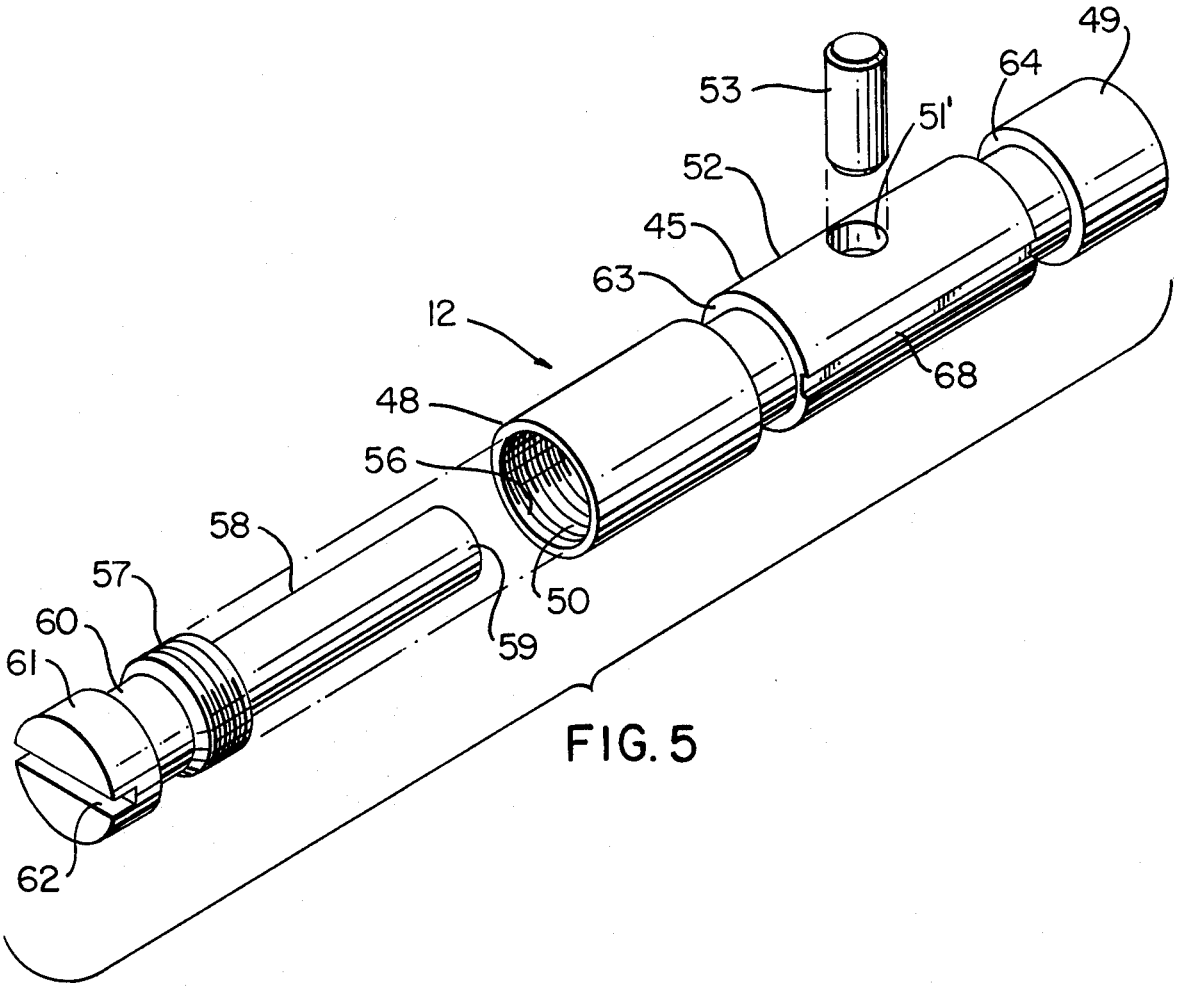
FIG. 5 is an enlarged exploded perspective view of the improved adjustable by-pass means of this invention as utilized in the control device of FIG. 2.

While only one longitudinal groove 68 is provided in the tubular member 45 as illustrated in FIGS. 1 and 3, it is to be understood that the tubular member 45 can be provided with a plurality of additional grooves 68 as desired. For example, see FIG. 4 wherein a second longitudinal groove 68' is provided in the tubular member 45 and is disposed diametrically opposite the first longitudinal groove 68 to also fluidly interconnect the annular grooves 63 and 64 together.

Thus, it can be seen that the adjustable by-pass means 12 of this invention can be formed in a relatively simple and inexpensive manner to be utilized with the control device 11 to provide not only a by-pass flow of fuel that by-passes the temperature responsive valve member 27 thereof, but also provides means for continuously supplying pilot burner fuel to the pilot burner 43, such operation of the adjustable by-pass means 12 of this invention when utilized in the control device 11 for the fuel control system 10 will now be described.

Assume that the control shaft 22 of the control device 11 is in an "off" condition so that the cam surface 23 of the control shaft 22 is so positioned that the force of the compression spring 21 and fuel pressure holds the poppet valve member 20 fully seated against the valve seat 19 whereby no fuel from the source 15 is provided in the chamber 25 of the control device 11 and, thus, no fuel is being directed to the main burner means 16 or pilot burner means 43.

With the control system 10 in this "off" condition and should the operator desire to utilize the cooking apparatus 14 to maintain a baking temperature within the oven cavity 13 thereof at say 400° F., the operator turns the control shaft 22 in an "on" direction thereof until the control shaft 22 is set at the selected 400° F. setting thereof. As the control shaft 22 is moved from the "off" condition thereof to the first "on" condition thereof, the cam surface 23 of the control shaft 22 pops the poppet valve means 20 to an open condition thereof against the force of the compression spring 21 and fuel pressure to permit fuel to flow from the source 15 into the chamber 25 of the control device 11. Simultaneously, the temperature responsive valve member 27 is moved to an opened condition relative to the valve seat 26 by the shaft 28 being threaded further onto the threaded stud 31 of the power element 33 because at the initial turning "on" of the control shaft 22, the temperature in the oven 13 is obviously at room temperature and not at the "on" temperature setting of the control shaft 22.

Thus, with fuel from the source 15 now present in the chamber 25 of the control device 11, a flow of fuel from passage 67, filter chamber 66 and passage 65 is directed by the interconnecting grooves 63, 68 and 64 of the tubular member 45 of the control device 11 to the conduit 44 as illustrated by the arrows in FIG. 1 whereby the fuel now issuing from the pilot burner 43 can be lit by a match or other ignition means to create the flame 42. When the flame 42 is created at the pilot burner 43, the flame 42 remains constant as long as the poppet valve member 20 is in the opened condition as illustrated in FIG. 1. The thus created flame 42 now ignites the fuel issuing from the burner ports 41 of the burner means 16 because the fuel from the chamber 25 of the control device 11 is not only being directed to the burner means 16 by the adjustable by-pass means 12, but also by the temperature responsive valve member 27 being in an opened condition relative to the valve seat 26 as illustrated by the arrows in FIG. 1.

In particular, fuel flows from chamber 25, passage 55, inlet 51 and passage 50 into the chamber 38 as well as from the chamber 25 and opened valve seat 26 into the chamber 38, chamber 38 directing its received fuel out of the outlet 39 and conduit 40 to the burner means 16.

As long as the temperature in the oven 13 remains below the selected 400° F. setting of the control device 11, the power element 33 maintains the valve member 27 in an opened condition relative to the valve seat 26 so that a full flow of fuel is directed to the burner means 16 to heat the oven cavity 13. However, when the temperature in the oven 13 reaches the selected 400° F., the power element 33 has expanded in such a manner that the movable wall 32 of the power element 33 has moved the valve member 27 fully against the valve seat 26 to close off the main flow of fuel to the burner means 16.

When the temperature responsive valve member 27 closes the valve seat 26, the adjustable by-pass means 12 provides a sufficient flow of fuel through the passage 50 thereof to the chamber 38 and, thus, to the main burner means 16 to just sustain flames at the burner ports 41, the adjusting member 58 of the adjustable by-pass means 12 having been adjusted so that the amount of by-pass flow of fuel to the main burner means 16 is only enough to support flames around the entire number of burner ports 41 in the burner means 16. Such by-pass flow of fuel to the main burner means 16 prevents the flames at the main burner means 16 from going completely out and allowing raw gas to be released into the oven 13 when the thermostatic valve 27 again opens relative to the valve seat 26 upon the temperature in the oven 13 falling below the selected 400° F.

Thus, when the temperature in the oven 13 falls below the selected 400° F. of the control shaft 22, the fluid in the bulb 37 has contracted sufficiently that the movable wall 32 moves the thermostatic valve member 27 away from the valve seat 26 to again supply a full flow of fuel to the main burner means 16 to cause the main burner means 16 to heat up the oven 13 to the selected 400° F.

In this manner, the temperature responsive valve member 27 is cycled between an opened and closed condition by the power element 33 to tend to maintain the temperature in the oven at the selected temperature setting of the control shaft 22, the by-pass means 12 supplying sufficient fuel to the burner means 16 to sustain combustion at the ports 41 each time that the valve member 27 is seated against the valve seat 26 and the adjustable by-pass means 12 continuously supplying fuel to the pilot burner means 43 to maintain the pilot flame 42 as long as the control shaft 22 is in a "on" position thereof so that the poppet valve member 20 is in an open condition thereof.

When the operator decides to cease utilizing the oven in the above manner, the control shaft 22 is turned to its "off" position whereby the cam surface 23 of the control shaft 22 permits the compression spring 21 and fuel pressure to fully seat the poppet valve member 20 against the valve seat 19 and thereby disconnect the fuel source 15 from the chamber 25 and, thus, not only from the main burner means 16 through the by-pass means 12 but also to the pilot burner 43 through the by-pass means 12 so that all flames cease to exist at the burner means 16 and 43.

Thus, each time it is desired to utilize the oven 13 in substantially the above manner, the pilot burner 43 must be lit by a match or other ignition means when the poppet valve member 20 is initially opened by the control shaft 22 being disposed in a "on" condition thereof.

Therefore, it can be seen that this invention not only provides an improved fuel control system and control device therefor, but also this invention provides an improved adjustable by-pass means for such control device and/or system or the like.

While the forms of this invention now preferred have been illustrated and described as required by the Patent Statute, it is to be understood that other forms can be utilized and still fall within the scope of the appended claims.

What is claimed is:

1. In a fuel control system having temperature responsive control means for thermostatically controlling the flow of fuel from a source thereof to a burner means and having adjustable by-pass means by-passing said temperature responsive means for providing a by-pass flow of fuel from said source to said burner means to sustain combustion at said burner means, the improvement wherein said by-pass means comprises a tubular member provided with an inlet and an outlet for respectively being interconnected to said source and said burner means, said tubular member having a passage therein interconnecting said inlet to said outlet, and an adjusting member carried by said tubular member for adjusting the rate of flow of fuel through said passage between said inlet and said outlet of said tubular member and, thus, the amount of fuel being by-passed to said burner means, said tubular member having means for interconnecting said source to a pilot burner means independent of said passage thereof.

2. A fuel control system as set forth in claim 1 wherein said tubular member has opposed ends, said passage passing completely through said ends of said tubular member, said adjusting member closing said passage at one of said ends of said tubular member.

3. A fuel control system as set forth in claim 2 wherein said inlet is formed transversely in said tubular member intermediate said opposed ends thereof, said outlet being at the other end of said tubular member.

4. A fuel control system as set forth in claim 3 wherein said adjusting member is adapted to block said passage at said inlet.

5. A fuel control system as set forth in claim 4 wherein said adjusting member is threadedly interconnected to said tubular member so as to provide for threaded adjustment therebetween.

6. A fuel control system as set forth in claim 1 wherein said means of said tubular member is provided in the exterior surface thereof.

7. A fuel control system as set forth in claim 6 wherein said means of said tubular member comprises annular groove means in said exterior surface of said tubular member.

8. A fuel control system as set forth in claim 7 wherein said annular groove means comprises a pair of annular grooves spaced from each other and each being substantially concentric with the longitudinal axis of said tubular member, said means of said tubular member including a longitudinally disposed groove in said exterior surface interconnecting said annular grooves together.

9. A fuel control system as set forth in claim 8 wherein said means of said tubular member includes another longitudinally disposed groove in said exterior surface interconnecting said annular grooves together and being diametrically opposed to the first-mentioned longitudinally disposed groove.

10. In a control device having temperature responsive valve means for thermostatically controlling the flow of fuel from a source thereof to a burner means and having adjustable by-pass means by-passing said temperature responsive means for providing a by-pass flow of fuel from said source to said burner means to sustain combustion at said burner means, the improvement wherein said by-pass means comprises a tubular member disposed in said control device and being provided with an inlet and an outlet for respectively being interconnected to said source and said burner means, said tubular member having a passage therein interconnecting said inlet to said outlet, and an adjusting member carried by said tubular member for adjusting the rate of flow of fuel through said passage between said inlet and said outlet of said tubular member and, thus, the amount of fuel being by-passed to said burner means, said tubular member having means for interconnecting said source to a pilot burner means indepedent of said passage thereof.

11. A control device as set forth in claim 10 wherein said tubular member has opposed ends, said passage passing completely through said ends of said tubular member, said adjusting member closing said passage at one of said ends of said tubular member.

12. A control device as set forth in claim 11 wherein said inlet is formed transversely in said tubular member intermediate said opposed ends thereof, said outlet being at the other end of said tubular member.

13. A control device as set forth in claim 12 wherein said adjusting member is adapted to block said passage at said inlet.

14. A control device as set forth in claim 13 wherein said adjusting member is threadedly interconnected to said tubular member so as to provide for threaded adjustment therebetween.

15. A control device as set forth in claim 10 wherein said means of said tubular member is provided in the exterior surface thereof.

16. A control device as set forth in claim 15 wherein said means of said tubular member comprises annular groove means in said exterior surface of said tubular member.

17. A control device as set forth in claim 16 wherein said annular groove means comprises a pair of annular grooves spaced from each other and each being substantially concentric with the longitudinal axis of said tubular member, said means of said tubular member including a longitudinally disposed groove in said exterior surface interconnecting said annular grooves together.

18. A control device as set forth in claim 17 wherein said means of said tubular member includes another longitudinally disposed groove in said exterior surface interconnecting said annular grooves together and being diametrically opposed to the first-mentioned longitudinally disposed groove.

19. An adjustable by-pass means for a control device to provide a by-pass flow of fuel from a fuel source to a burner means to sustain combustion at said burner means, said by-pass means comprising a tubular member provided with an inlet and an outlet for respectively being interconnected to said source and said burner means, said tubular member having a passage therein interconnecting said inlet to said outlet, and an adjusting member carried by said tubular member for adjusting the rate of flow of fuel through said passage between said inlet and said outlet of said tubular member and, thus, the amount of fuel being by-passed to said burner means, said tubular member having means for interconnecting said source to a pilot burner means independent of said passage thereof.

20. An adjustable by-pass means as set forth in claim 19 wherein said tubular member has opposed ends, said passage passing completely through said ends of said tubular member, said adjusting member closing said passage at one of said ends of said tubular member.

21. An adjustable by-pass means as set forth in claim 20 wherein said inlet is formed transversely in said tubular member intermediate said opposed ends thereof, said outlet being at the other end of said tubular member.

22. An adjustable by-pass means as set forth in claim 21 wherein said adjusting member is adapted to block said passage at said inlet.

23. An adjustable by-pass means as set forth in claim 22 wherein said adjusting member is threadedly interconnected to said tubular member so as to provide for threaded adjustment therebetween.

24. An adjustable by-pass means as set forth in claim 19 wherein said means of said tubular member is provided in the exterior surface thereof.

25. An adjustable by-pass means as set forth in claim 24 wherein said means of said tubular member comprises annular groove means in said exterior surface of said tubular member.

26. An adjustable by-pass means as set forth in claim 25 wherein said annular groove means comprises a pair of annular grooves spaced from each other and each being substantially concentric with the longitudinal axis of said tubular member, said means of said tubular member including a longitudinally disposed groove in said exterior surface inerconnecting said annular grooves together.

27. An adjustable by-pass means as set forth in claim 26 wherein said means of said tubular member includes another longitudinally disposed groove in said exterior surface interconnecting said annular grooves together and being diametrically opposed to the first-mentioned longitudinally disposed groove.

* * * * *